US005137986A

United States Patent [19]

Uy

[11] Patent Number: 5,137,986

[45] Date of Patent: Aug. 11, 1992

[54] SPINNABLE DOPES AND ARTICLES THEREFROM

[75] Inventor: William C. Uy, Wilmington, Del.

[73] Assignee: E. I. du Pont de Nemours and Company, Wilmington, Del.

[21] Appl. No.: 319,492

[22] Filed: Mar. 6, 1989

Related U.S. Application Data

[63] Continuation-in-part of Ser. No. 91,001, Sep. 2, 1987, Pat. No. 4,810,735, which is a continuation-in-part of Ser. No. 919,028, Oct. 15, 1986, abandoned, and a continuation-in-part of Ser. No. 33,259, Apr. 2, 1987, abandoned.

[51] Int. Cl.[5] ..... C08L 77/00

[52] U.S. Cl. ..... 525/432; 525/417; 525/420

[58] Field of Search ..... 525/417, 420, 432

[56] References Cited

U.S. PATENT DOCUMENTS 4,631,318 12/1986 Hwang ..... 525/432

FOREIGN PATENT DOCUMENTS 2195672 4/1988 United Kingdom .

*Primary Examiner*—Paul R. Michl
*Assistant Examiner*—Peter Szekely

[57] ABSTRACT

As-spun fibers from certain spinnable dopes of poly-p-phenylenebenzobisthiazole, poly-p-phenylenebenzobisoxazole, or poly-2,5-benzoxazole and thermoplastic polymers in certain mixed solvents are provided.

2 Claims, 2 Drawing Sheets

SPINNABLE DOPES AND ARTICLES THEREFROM

RELATED APPLICATIONS

This application is a C-I-P of my application Ser. No. 07/091,001 now U.S. Pat. No. 4,810,735 which is a C-I-P of my application Ser. No. 919,028 filed Oct. 15, 1986 and Ser. No. 033,259 filed Apr. 2, 1987, both now abandoned.

BACKGROUND

Poly-p-phenylenebenzobisthiazole, poly-p-phenylenebenzobisoxazole and poly-2,5-benzoxazole are intractable polymers by which is meant they are non-melting but soluble. Mixtures of these polymers have been made with thermoplastic polymers to provide melt-processability. Mixtures of these polymers with other intractable polymers have been made for various purposes. Procedures for making these mixtures have, in general, required isolation of the intractable polymer from its polymerization solvent, polyphosphoric acid, and its combination with a solution of the other polymer is methanesulfonic acid. The ternary composition, namely, the two polymers and single solvent were then extruded to form fiber.

SUMMARY OF THE INVENTION

This invention provides an as-spun fiber comprising a polymer mixture of a first polymer selected from the group of poly-p-phenylenebenzobisthiazole and poly-p-phenylenebenzobisoxazole and a second polymer from the class of thermoplastic polymers in the proportions of from 40 to 70 volume % of the first polymer with the remainder comprising the thermoplastic polymer, said fiber having an orientation angle of less than about 18° with the two polymers being disposed within the fiber in cocontinuous biphasic form. The as-spun fiber may be heat-treated to reduce the orientation angle.

The product is made by air-gap spinning a quaternary dope containing a combination of the first and second polymers in the required proportions, at a concentration of at least 8% by weight of the dope, the solvent portion of said dope comprising the combination of polyphosphoric acid and methanesulfonic acid, chlorosulfonic acid or an equivalent strong acid.

DRAWINGS

DETAILED DESCRIPTION OF THE INVENTION

Poly-p-phenylenebenzobisthiazole (PBT), and poly-p-phenylenebenzobisoxazole (PBO) are prepared in polyphosphoric acid (PPA) (see U.S. Pat. No. 4,533,693). Since they are highly intractable polymers, hence not amenable to melt-processing, efforts have been made to combine them with thermoplastic polyamides. The procedure normally followed, involves isolating the PBT or PBO from the polymerization solvent and redissolving it in methanesulfonic acid at low concentrations. The thermoplastic polyamide is then added to the solution such that the total polymer concentration is under 5 percent by weight. The solution is then processed into fibers or films.

The present invention provides a novel as-spun fiber obtained by spinning a quaternary dope. It involves first preparing a solution of a thermoplastic polymer in methanesulfonic acid (MSA) or chlorosulfonic acid or an equivalent strong acid. Any of a variety of thermoplastic polymers may be used as the second component which provides the matrix polymer of the fiber. Thermoplastic and particularly amorphous thermoplastic polyamides are preferred. The concentration of the thermoplastic polymer in solution may range from about 8–20% on a weight basis.

To the solution of the thermoplastic one adds a solution of PBT or PBO in the polyphosphoric acid polymerization solvent and then shear mixes the combined solutions. Preferably the PBT or PBO should have an intrinsic viscosity of at least 15 dL/g as measured in MSA. The concentration of the PBT or PBO in the polyphosphoric acid should be at least 8 and preferably between 8 and 20 weight percent. The combined polymer concentration of the resulting quaternary solution should be at least 8% and preferably from 10–20% by weight. The presence of PPA increases spin solution viscosity for improved spinnability. In practice, chunks of the PBT or PBO in polyphosphoric acid are added to the thermoplastic polymer solution with shear mixing, preferably without applying external heating to avoid degradation of less stable thermoplastic polymer. An Atlantic Mixer is quite useful for this purpose, shearing being effected by the wall wiping mechanism. The proportions of the solutions are selected to yield the ratio of PBT or PBO to thermoplastic desired in the dope. It is preferred that the concentrations of both solutions be about equal so that the final concentration of total polymer in the quaternary dope remains constant while the ratio of the two solutions are varied to obtain different polymer ratios. To obtain maximum benefits, the PBT or PBO should constitute at least 40% by volume and preferably from 40–60% by volume of the polymer mixture. The second polymer should constitute the remainder of the polymer mixture.

Figure 1:
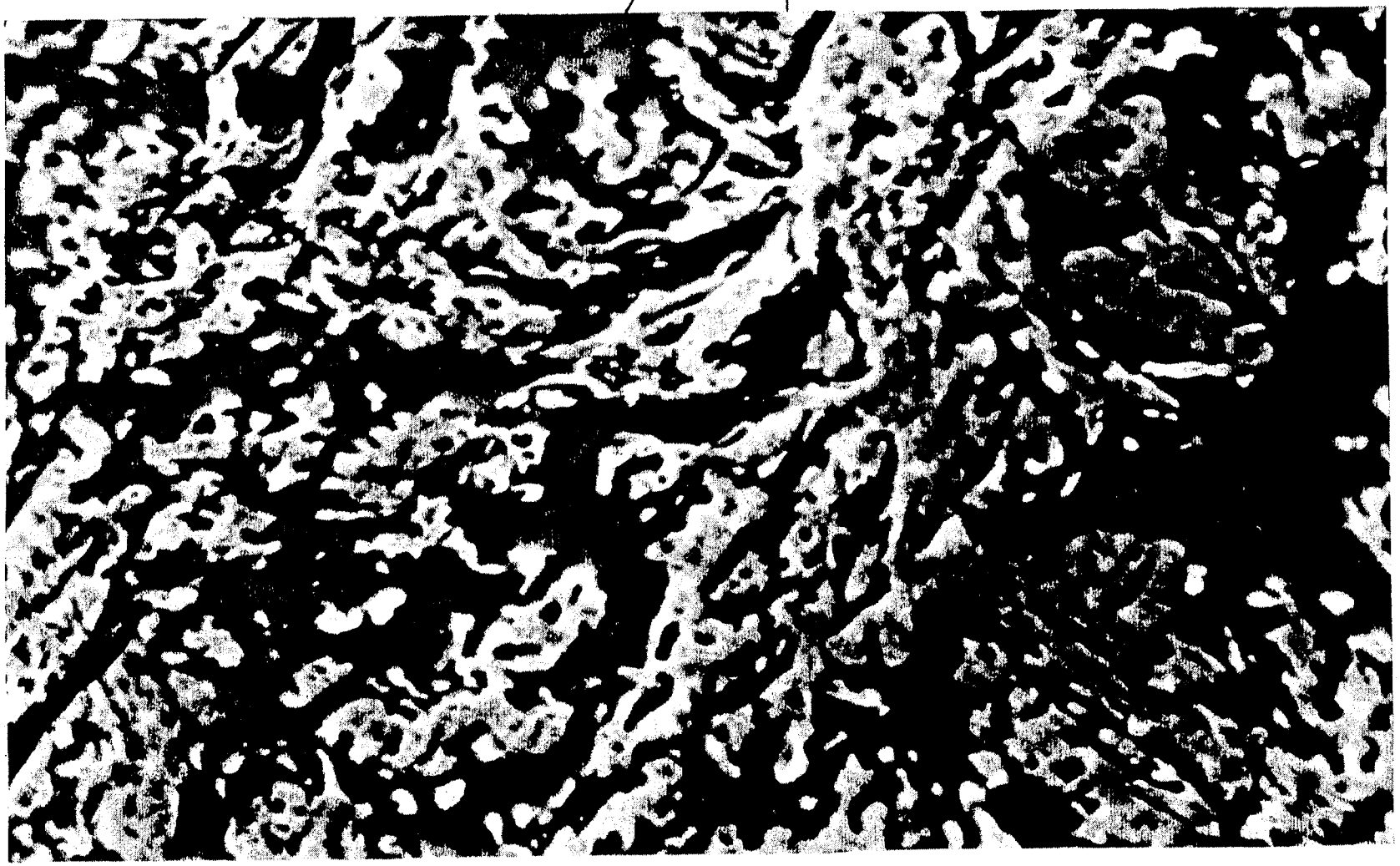
FIG. 1 is a photomicrograph of the transverse cross-section taken at a magnification of 15,000 X, of an as-spun fiber of the invention.
Figure 2:
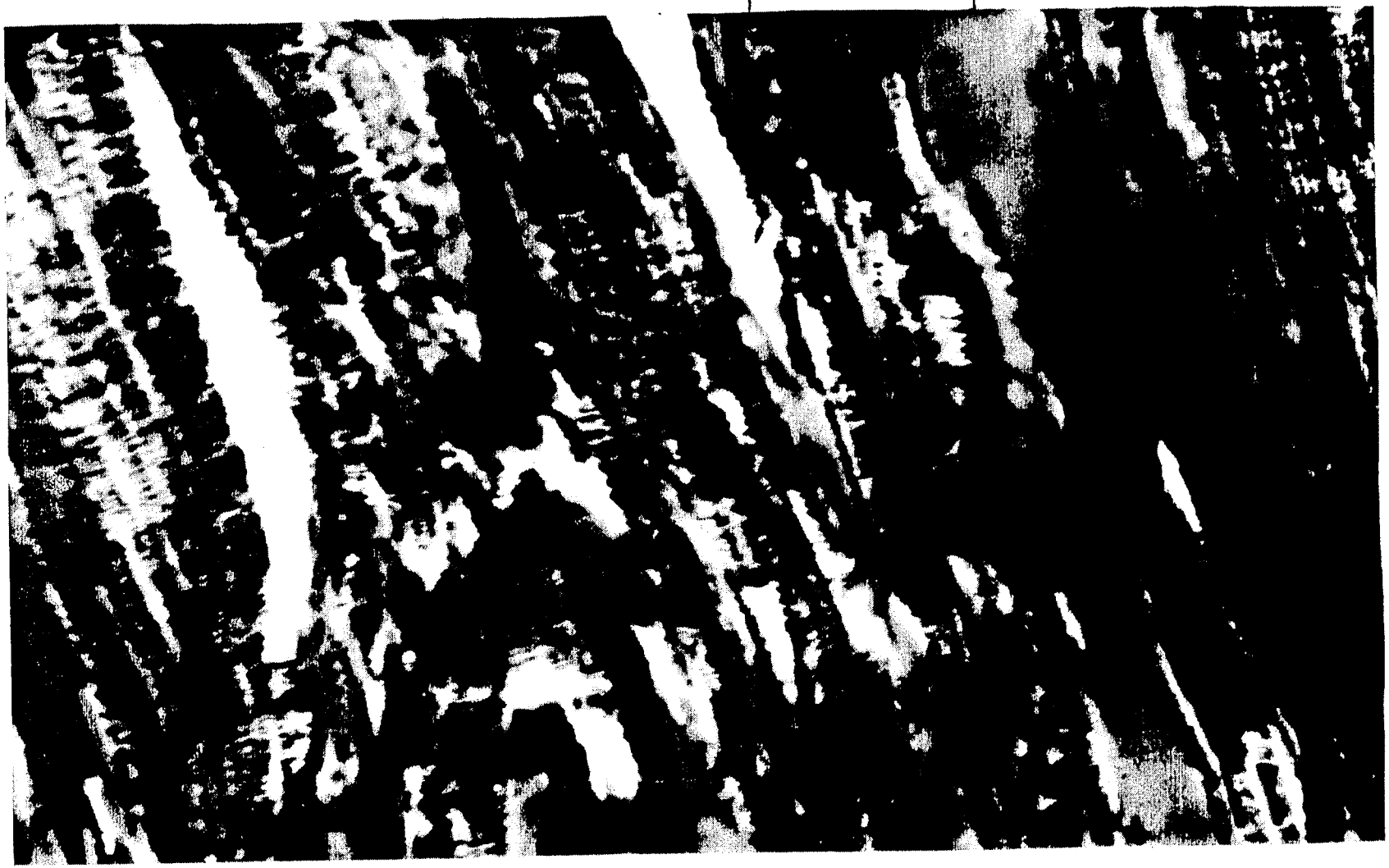
FIG. 2 is a photomicrograph of the longitudinal cross-section taken at a magnification of 15,000 X of an as-spun fiber of the invention.

The present invention provides advantages of operation since the PBT or PBO need not be separated from the polymerization solvent. Further, by combining the polymers as solutions an obstacle previously facing the art was removed. Thermoplastic polyamide, for example, is relatively insoluble in polyphosphoric acid at room temperature. When heating to promote dissolution in the polyphosphoric acid, it is found that there is severe degradation of the thermoplastic polyamide. Surprisingly, the solutions can be combined with shear mixing without use of the high temperatures that would degrade the thermoplastic polyamide. A further advantage is that the rheology of the resulting quaternary solution from the combined solutions is such as to permit air-gap spinning. Fibers spun from such quaternary solutions have been found to possess lower orientation angles, below 18° and tensile properties that are substantially greater than those spun from ternary solutions of the same polymer combination. Novel microstructures have been observed in scanning electron micrographs of longitudinal cross-sections and cross-sections transverse to the fiber length. The photomicrographs of the figures were taken of the as-spun fiber of Example 3 below. In FIG. 1 the areas 1 are what is referred to herein as the first polymer while areas 2 are what is referred to herein as the second or matrix polymer. In FIG. 2 the first polymer is seen as long domains extending along the fiber length. These views are representative of what occurs in the as-spun fiber and establishes the existence of the two co-continuous polymer phases. It is believe that this structure contributes to the high tensile properties, particularly the modulus.

Heat treatment of the as-spun fiber will result in a lowering of the orientation angle. Films, bars and other composite articles may be prepared by winding the composite fibers of the invention containing a thermoplastic polymer as the second polymer into a form and compression molding it with heat.

The following examples except for the Control illustrate the invention and are not intended as limiting. Intrinsic viscosities were measured in MSA:

EXAMPLE 1

15 parts by weight of thermoplastic polyamide were added to 85 parts by weight of MSA in a glass jar and stirred at room temperature using a simple polytetrafluoroethylene coated magnetic stirrer. The thermoplastic polyamide employed is an amorphous copolymer of (48tt) bis(p-aminocyclohexyl)methane, isophthalic and dodecanedioic acids in a 100/60/40 mol percent basis. The solution was a brown viscous liquid. 60.5 g of the solution was poured into an Atlantic Mixer (Model No. 2CV, Capacity: 150 cc). Then 61.8 grams of a 14.5 wt. % dope of PBT (19.6 dL/g intrinsic viscosity) in PPA were added to the mixture with the mixer operating at low speed and without applying external heating. The PBT/PPA dope broke up and "dissolved" into the polyamide-MSA solution. Mixing was continued into the next day, when the mixture became homogeneous. The resulting quaternary solution or dope exhibited shear opalescence. It was stirred and deaerated under vacuum overnight. The dope was transferred to a spin cell and spun at 54° C. through a 0.25 inch air gap into an ice water bath to extract solvent. The dope was spun from a 10-hole spinneret (0.004 in holes) at 7.5 m/min. The through-put rate was 0.02 ml/min/hole. To ensure complete removal of the acid solvents, bobbins of yarn were immersed in water overnight and then air dried. The as-spun composite yarn (PBT/polyamide, 50/50 by weight or 42/58 by volume) had the following filament tensile properties (denier, tenacity, elongation, modulus) (D/T/E/M): 66 denier, 4.3 gpd, 1.4%, 344 gpd. and an orientation angle of 15°. Thermal stability was evaluated by threading the yarn through a horizontal hot tube with one end tied and a 10-gram load on the other end. The temperature was raised to 716° C. over a period of 3 hours 30 minutes at which point the yarn broke.

EXAMPLE 2

15 grams of an amorphous thermoplastic polyamide, a copolymer of hexamethylene diamine, (20tt) bis(p-aminocyclohexyl)methane, isophthalic and terephthalic acids in a 96/4/70/30 mol percent basis, was dissolved in 85 grams of MSA at room temperature. 72.3 grams of the solution was mixed with 73.2 grams of the same PBT/PPA dope used in Example 1 to give PBT/polyamide weight ratio of 50/50 and MSA/PPA solvents ratio of 50/50. The mixing was done without external heat. After several hours, a homogeneous quaternary spin dope was obtained. It was shear opalescent and light metallic green. Mixing was continued to the next day when vacuum was applied to deaerate the dope. After remaining quiescent over a weekend, some phase separation took place. The dope was mixed for 2.5 hours before transferring to the spin cell. It was spun at 60° C. from a 10-hole spinneret of 0.005 in hole diameter through a 0.75 in air gap at 7.5 m/min with spin-stretch factor of 4.7 into ice water. The yarn was immersed in water for several days, then in acetone to remove any residual MSA and then air dried. The 50/50 PBT/polyamide composite fiber tensile properties (T/E/M) are: 3.7 gpd, 0.6%, 390 gpd. The same thermal stability test was made as in Example 1 and the yarn survived till 723° C. In a separate experiment, a higher PBT to polyamide ratio of 62/38 was used. The spun composite fiber had T/E/M properties of 5.7 gpd/0.82/691 gpd.

EXAMPLE 3

A solution was made using 30 grams of the polyamide of Example 1 and 170 grams of MSA. 94.2 grams of this solution were mixed with 141.3 grams of the same PBT/PPA dope used in the above examples to make a spin dope where the PBT/polyamide ratio was 60/40 by weight or 53/47 by volume and MSA/PPA ratio of 40/60. The homogeneous quaternary spin dope was heated to 60° C. to reduce viscosity for transfer to the spin cell. Yarn was spun at 75° C. through a 0.375 in air gap, at 7.5 m/min using 10-hole spinneret with 0.005 in holes. Spinning was excellent. After overnight immersion in water, the bobbin of yarn was immersed in acetone the next night to extract any residual MSA. The dried composite fiber T/E/M properties are 5.3 gpd/1.0%/342 gpd.

EXAMPLE 4

A spin dope of PBT and the polyamide of Example 1 at a polymer ratio of 59.2/40.8 by weight (51/49 by volume) was made using 54.3 grams of the polyamide/MSA solution of Example 3 and 81.4 grams of the same PBT/PPA dope used in the above examples. The resulting quaternary spin dope with a MSA/PPA ratio of 40/60 was mixed without external heating. On the following day, the temperature was raised to and kept at 75° C. for 1.5 hours to reduce viscosity before transfer to the spinning cell. Yarn was spun at 75° C., through a 0.5 in air gap, at 7.5 m/min using a 10-hole spinneret having 0.005 in holes. The as-spun composite fiber had T/E/M properties of 7.3 gpd/1.5%/586 gpd.

EXAMPLE 5

A quaternary spin dope containing cis-PBO and the polyamide of Example 1 in a 66/34 weight ratio (59/41 by volume) was made using 65.2 grams of 15% of the polyamide in MSA and 136.2 grams of 14.1% cis-PBO (intrinsic viscosity of 16.6 dL/g) in PPA. The mixture with a MSA/PPA ratio of 32/68 was mixed overnight under house vacuum (24 in vacuum) without applying external heat. The resulting quaternary dope was heated to 60° C. the next day to improve flowability for filling the spin cell. The dope was shear anisotropic. Yarn was spun at 60° C. through a 0.75 in air gap at 7.5 m/min using a 10-hole (0.005 in holes) spinneret. The composite fiber has the following T/E/M tensile properties: 8.4 gpd/2.2%/324 gpd. The fiber orientation angle is 17°.

CONTROL

This example illustrates a product outside of the present invention, made by spinning a dope of a too low polymer concentration.

A quaternary spin dope consisting of 3.0 weight percent solids (60 weight percent PBT/40 weight percent) of the polyamide of Example 1, in 97 weight percent mixed solvents (50 weight percent MSA/50 weight percent PPA) was prepared from a solution of the polyamide of Example 1 at 1.35 weight percent concentration in MSA/PPA (55.9 weight percent MSA/44.1 weight percent PPA) and a dope of PBT (17.0 dL/g intrinsic viscosity) at 14.9 weight percent concentration of PPA. Preparation was as follows: 110.2 grams of MSA and 87.0 grams of PPA were mixed together in a glass jar at room temperature using a "Teflon" coated magnetic stirrer. 2.7 grams of the polyamide was added to the MSA/PPA mixed solvents and stirred at room temperature. The solution was poured into an Atlantic Mixer. Then 27.3 grams of the PBT/PPA dope were added to the Mixer while operating at slow speed under vacuum (for deaeration) without applying external heat. The PBT/PPA dope was found to gradually break up and "dissolve" into the polyamide MSA/PPA solution. The next day there were still a few chunks of PBT/PPA dope stuck at the top of the Mixer blades. The chunks of PBT/PPA dope were scraped into the rest of the spin dope, and mixing was continued into the next day when the mixture became a homogeneous phase, gel-like in consistency. The quaternary spin dope was transferred to a spin cell and air-gap spun (0.25 in air-gap) at room temperature at 12.6 meter/minute using a 10-hole spinneret with hole diameter of 0.005 in and a spin-stretch factor of 4.0 [a 10-hole spinneret with a hole diameter of 0.010 in was also used to air-gap spin (0.25 in air-gap) yarn at room temperature and 2.0, 4.0 and 6.0 meter/minute with a spin-stretch factor of 2.5, 5.0, and 7.6, respectively.] The throughput rate was 0.04 ml/min/hole. To ensure complete removal of the acid solvents, the bobbins of yarn were immersed in water (the extraction solvent) overnight and then air dried. The as-spun yarn (PBT/polyamide, 60/40 by weight or 52/48 by volume) tensile properties (denier, tenacity, elongation, modulus) are: 39 denier, 2.2 gpd, 6.3%, 113 gpd. The orientation angle measured by wide angle X-ray diffraction is 40°. The relatively low tensile properties are attributed to inadequate deaeration.

I claim:

1. An as-spun fiber comprising a polymer mixture of a first polymer selected from the group of poly-p-phenylenebenzobisthiazole and poly-p-phenylenebenzobisoxazole and a second polymer from the class of thermoplastic polymers in the proportions of from 40 to 70 volume % of the first polymer with the remainder comprising the thermoplastic polymer, said fiber having an orientation angle of less than about 18° with the two polymers being disposed within the fiber in co-continuous biphasic form.

2. An as-spun fiber according to claim 1 wherein the thermoplastic polymer is an amorphous polyamide.

* * * * *